US005124713A

United States Patent [19]

Mayes et al.

[11] Patent Number: 5,124,713

[45] Date of Patent: Jun. 23, 1992

[54] PLANAR MICROWAVE ANTENNA FOR PRODUCING CIRCULAR POLARIZATION FROM A PATCH RADIATOR

[76] Inventors: Paul E. Mayes, 1508 Waverly Dr., Champaign, Ill. 61821; Hugh K. Smith, 2111-201 Hazelwood Dr., Urbana, Ill. 61801; James R. Gentle, 810 Main St., Apt. 12, El Segundo, Calif. 90425

[21] Appl. No.: 584,197

[22] Filed: Sep. 18, 1990

[51] Int. Cl.[5] ..... H01Q 1/38; H01Q 21/24

[52] U.S. Cl. ..... 343/700 MS; 343/846

[58] Field of Search ..... 343/700 MS, 767, 770, 343/756, 846

[56] References Cited

U.S. PATENT DOCUMENTS 2,654,842 10/1953 Engelmann ..... 343/770
4,903,033 2/1990 Tsao et al. ..... 343/700 MS

FOREIGN PATENT DOCUMENTS 141807 11/1980 Japan ..... 343/767
293704 11/1989 Japan .

OTHER PUBLICATIONS

Breithaupt, "Conductance Data for Offset Series Slots in Stripline", IEEE Trans. on Microwave Theory and Techniques, vol. MTT-16, No. 11, Nov. 1968, pp. 969-970.

John L. Kerr, "Microstrip Polarization Techniques", Sep., pp. 1-17, U.S. Army Surveillance and Target Acquision Laboratory, Fort Monmouth, N.J. 07703.

M. Irsadi Aksun et al. "On Slot-Coupled Microstrip Antennas and Their Application to CP Operation-Theory and Experiment", IEEE Transactions on Antennas and Propagation, Aug. 1990, pp. 1224-1230.

Andrew Adrian, "Investigation of Some Antenna Elements for Advanced Phased Arrays", May 1987, pp. 1-137, Master of Science, Electrical and Computer Engineering, Univ of Mass.

*Primary Examiner*—Michael C. Wimer
*Attorney, Agent, or Firm*—David N. Koffsky

[57] ABSTRACT

A planar antenna is described which employs a thin patch of conductive material supported above and substantially parallel to a closely spaced thin conductive ground surface. Two or more narrow slots are positioned in the ground surface beneath the conductive patch. A microstrip transmission line, placed below the ground surface, excites the slots in series. The length of the microstrip line between the slots, the position of the microstrip line across the slots, and the dimensions of the slots are chosen to excite two orthogonal modes in the conductive patch in phase quadrature. This excitation results in a planar antenna which receives and transmits electromagnetic waves of circular polarization. The antenna may also employ a coplanar waveguide transmission line instead of the aformentioned microstrip transmission line. The coupling apertures then form slot discontinuities in series with the coplanar transmission line, which are positioned under the conductive patch. The antenna may also employ several conductive patches stacked over each other in a parallel fashion to enhance antenna performance.

18 Claims, 3 Drawing Sheets

PLANAR MICROWAVE ANTENNA FOR PRODUCING CIRCULAR POLARIZATION FROM A PATCH RADIATOR

FIELD OF THE INVENTION

This invention relates to planar microwave antennas, and more particularly, to microstrip and coplanar feeds for exciting antennas of a planar variety to transmit and/or receive electromagnetic waves of circular polarization.

BACKGROUND OF THE INVENTION

In the last decade, antennas constructed using printed circuit techniques have become popular, especially for mobile applications. These antennas are often thin and can be affixed to a vehicle, aircraft, etc. without appreciably altering the aerodynamics of the host structure.

In the prior art, a single slot has been used to enable printed circuit antennas to transmit and receive electromagnetic waves of circular polarization (CP). Kerr and others have demonstrated that strategically placing an elongated slot in the planar conductor of a printed circuit antenna can successfully enable the antenna to receive and transmit circularly polarized electromagnetic waves over a narrow band of frequencies (see "Microstrip Polarization Techniques", by John L. Kerr in the Proceedings of the 1978 Antenna Applications Symposium).

Later, it was shown that a single slot in the ground plane beneath a planar conductor of a printed circuit antenna can be used as both the method of excitation and the means to enable the antenna to operate in a circularly polarized (CP) manner (see "On slot-coupled microstrip antennas and their applications to cp operation—theory and experiment", by Aksum, Chuang, and Lo in the IEEE transactions on Antennas and Propagation, August 1990). However, the successful operation of either of the above-noted approaches is confined to an extremely narrow range of frequencies.

Greater CP bandwidths can be obtained from printed circuit antennas by providing multiple feeds. These feeds may be in the form of coupling apertures in the ground plane, probes extending between the planar antenna conductor and the ground plane, or microstrip transmission lines on the same surface as the antenna conductor.

In order to produce CP, proper amplitude and phasing of the exciting electromagnetic energy must be provided at the aperture feed points. The aperture feed systems of the prior art require power splitters and phase shifters, usually in the form of a 90-degree hybrid (see "Investigation of some antenna elements for advanced phased arrays", which is a Master of Science Thesis by A. Adrian, University of Mass., 1987). Although a large CP bandwith is thus obtained, the aperture-feed circuitry requires several components and occupies space, which may be in short supply.

Aperture-coupling techniques have several advantages over other feed methods. For example, layered construction using aperture coupling is applicable to microwave monolithic integrated circuit (MMIC) technology and eliminates the need for conductive interconnects between conductive layers. In addition, the multilayer design allows the feed circuitry to be constructed on a material with a high dielectric constant, such as a semiconductor material, while the printed circuit antenna is placed above a substrate with a lower dielectric constant. The radiating element is thus, more efficient. Furthermore, the ground plane isolates the feed circuitry from the environment of the antenna, thus removing the effects due to radiation from the feed.

Accordingly, it is an object of this invention to provide a planar antenna which is excited by an aperture-coupling technique and employs a simple feed network.

It is a further object of this invention to provide a planar antenna which is adapted to transmit and receive waves of circular polarization.

It is another object of this invention to provide CP operation in a planar antenna over a greater bandwidth than prior art antennas employing single slot apertures.

SUMMARY OF THE INVENTION

A planar antenna is described which employs a thin patch of conductive material supported above and substantially parallel to a closely spaced thin conductive ground surface. Two or more narrow slots are positioned in the ground surface beneath the conductive patch. A microstrip transmission line, placed below the ground surface, excites the slots in series. The length of the microstrip line between the slots, the position of the microstrip line across the slots, and the dimensions of the slots are chosen to excite two orthogonal modes in the conductive patch in phase quadrature. This excitation results in a planar antenna which receives and transmits electromagnetic waves of circular polarization.

The antenna may also employ a coplanar waveguide transmission line instead of the aformentioned microstrip transmission line. The coupling apertures then form slot discontinuities in series with the coplanar transmission line, which are positioned under the conductive patch. The antenna may also employ several conductive patches stacked over each other in a parallel fashion to enhance antenna performance.

DETAILED DESCRIPTION OF THE INVENTION

Figure 1:
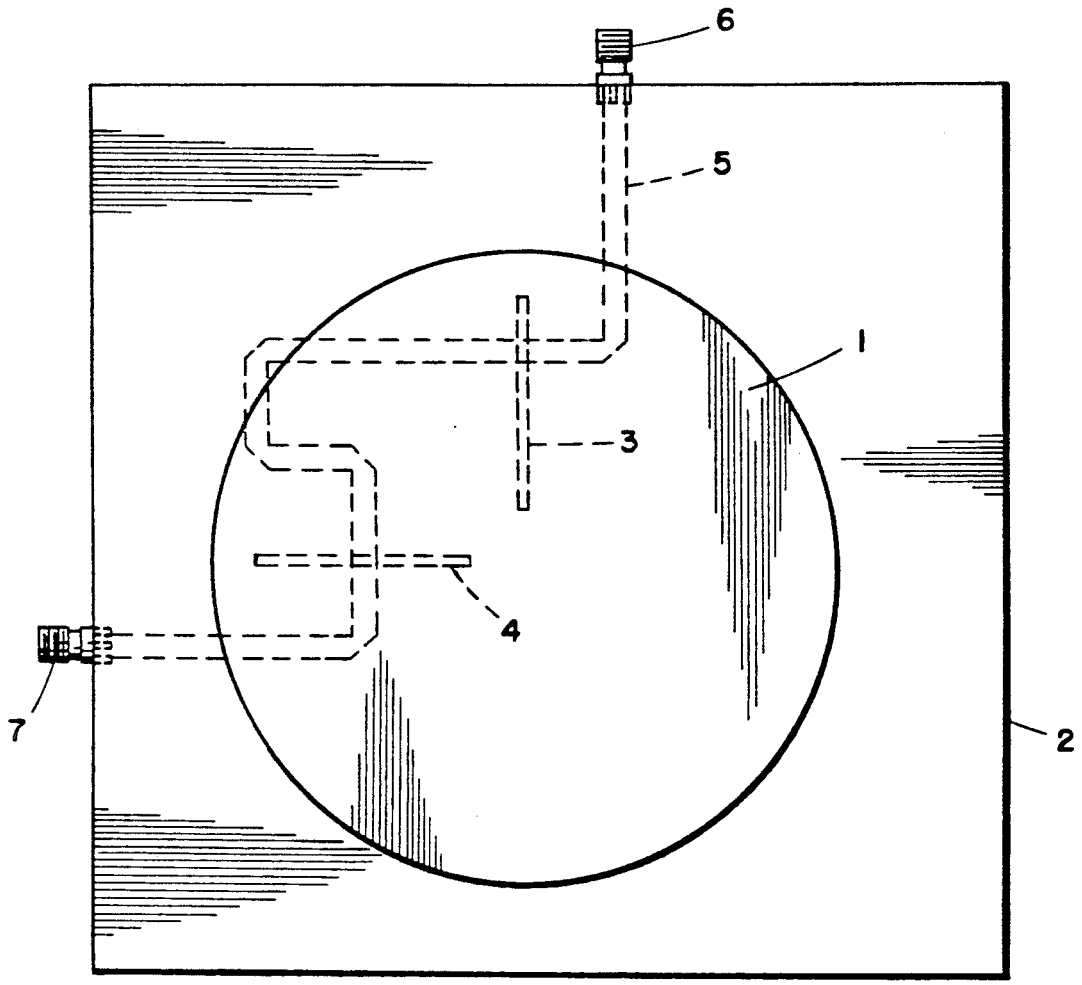
FIG. 1 is a top view of a planar antenna incorporating the invention, with a microstrip feed line.
Figure 2:
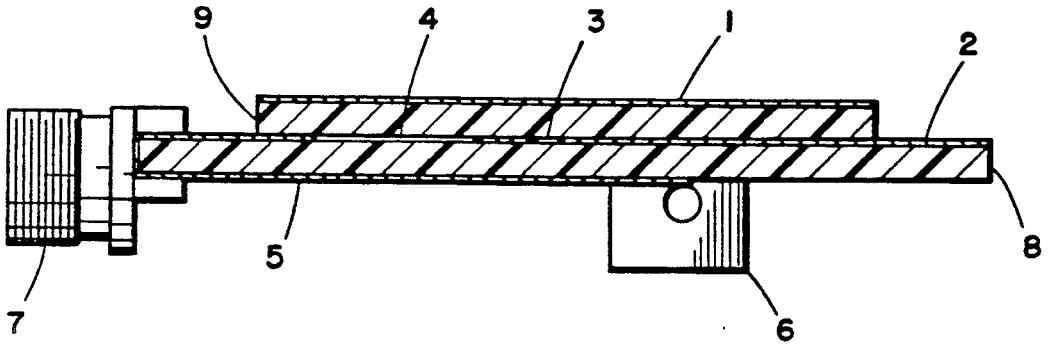
FIG. 2 is a side view of the planar antenna of FIG. 1.

Referring now to FIGS. 1 and 2, a first embodiment of the invention will be described. Electromagnetic energy is introduced at a first input/output port 6. The energy is guided along a microstrip transmission line which comprises a strip of conducting material 5 that is separated from a ground plane 2 by a microwave energy-carrying dielectric substrate 8. Ground plane 2 is supported by dielectric substrate 8, and a circular conductive patch radiator 1 is positioned thereover, on a dielectric layer 9.

Figure 6:
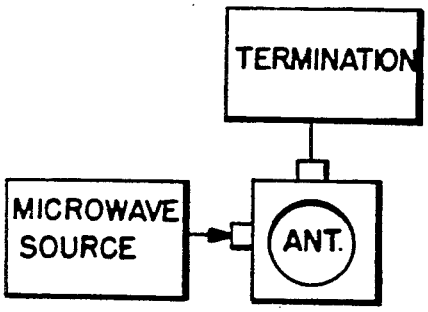
FIG. 6 is a top view of a planar antenna incorporating the invention, with energy coupled into one port and terminated at a second port.

Ground plane 2 has formed therein, a pair of orthogonally oriented coupling apertures 3 and 4. While dielectric substrates 8 and 9 can be comprised of the same material, it is preferred that substrate 8 exhibit a higher dielectric constant than substrate 9 to improve antenna efficiency. When energy is coupled into input/output port 6, input/output port 7 is terminated in the characteristic impedance of the transmission line, for example, as shown in FIG. 6.

When the electromagnetic energy reaches first coupling aperture 3, some is reflected back towards port 6 along the transmission line, some continues to propagate past aperture 3 along the transmission line, and some is coupled to conductive patch radiator 1.

The electromagnetic energy which propagates past aperture 3 continues along the microstrip transmission line until it encounters second coupling aperture 4. Again some electromagnetic energy is reflected back towards port 6, some is transmitted past aperture 4, and some is coupled to patch 1 through aperture 4. The remainder of the electromagnetic energy then passes through a second input/output port 7. The length of the transmission line between the apertures, the position of the coupling apertures relative to the radiating patch, the dimensions of the coupling apertures, and the location at which the transmission line passes over the coupling apertures all work in concert to adapt the antenna for circular polarization. In the case of the circular patch of FIG. 1, the effect is to excite two orthogonal $TM_{11}$ modes in equal amplitude phase quadrature.

Coupling apertures 3 and 4 are long, narrow, high aspect ratio rectangular slots (their length is many times greater than their width). Their dimensions are adjusted to couple sufficient energy from microstrip transmission line 5 to excite the TM11 mode of circular patch radiator 1. Apertures 3 and 4 are preferably identical in dimension and are placed in ground plane 2, beneath conductive patch 1. Each aperture is centered on a diagonal of patch radiator 1, with the two diagonals oriented orthogonally with respect to each other. As thus oriented, apertures 3 and 4 couple electromagnetic energy from the microstrip transmission line into two orthogonal TM11 modes of patch 1.

The microstrip transmission line passes under aperture 3 in an asymmetric fashion and under aperture 4 in a symmetric fashion. This is done to couple equal amounts of energy into the orthogonal TM11 modes. Since more energy is available at aperture 3 than at aperture 4, the amount of coupling at aperture 3 is reduced by having the microstrip pass under the slot in an asymmetric fashion. In lieu of asymmetric positioning of the transmission line with respect to identically sized apertures, different sized apertures may be employed to assure equal energy coupling to radiating patch 1.

The length of the transmission line between apertures 3 and 4 is adjusted so that the electromagnetic energy at the respective apertures is 90 degrees out of phase. This structure enables two orthogonal TM11 modes to be excited in patch 1, of equal amplitude and in phase quadrature.

Figure 3:
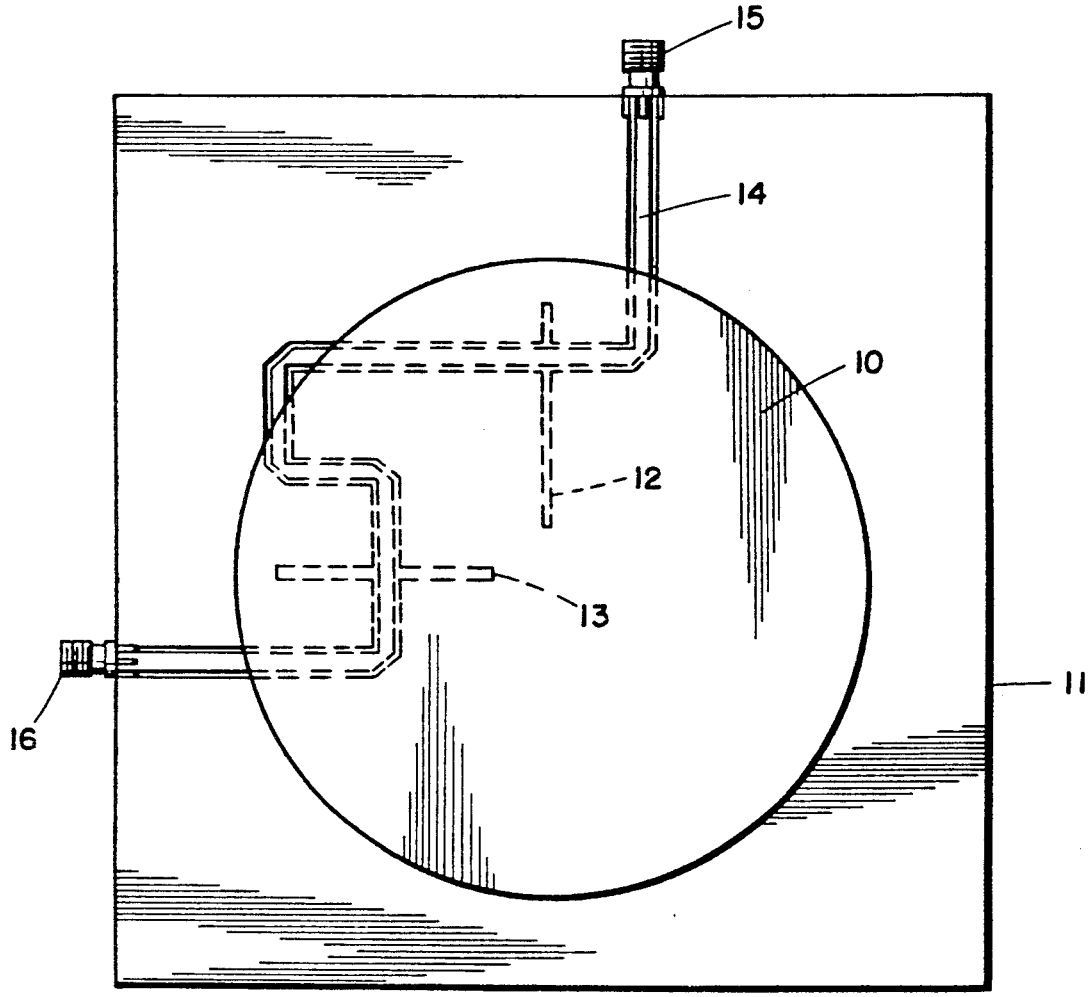
FIG. 3 is a top view of a planar antenna incorporating the invention, with a coplanar feed line.
Figure 4:
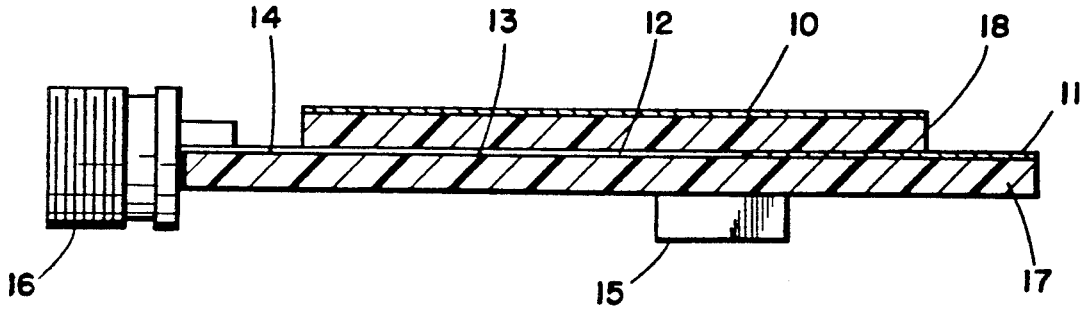
FIG. 4 is a side view of the planar antenna of FIG. 3.

Referring now to FIGS. 3 and 4, electromagnetic energy is introduced at a first port 15. The energy is guided along a coplanar transmission line 14 which is formed directly in ground plane 11 by separating its central conductor from the remainder of the ground plane through a suitable etching or deposition process. The ground plane may or may not be backed by a microwave dielectric substrate 17. A conductive radiating patch 10 is supported above ground plane 11 by dielectric substrate 18.

The electromagnetic energy is guided along coplanar transmission line 14 until it encounters a first coupling aperture 12. Some electromagnetic energy is reflected back along transmission line 14, some continues to propagate past aperture 12, and some is coupled to conductive patch 10. The electromagnetic energy which propagates past aperture 12 proceeds on its course along coplanar transmission line 14 until it encounters a second coupling aperture 13. Again some electromagnetic energy is reflected, some energy proceeds past the aperture, and some energy is coupled through aperture 13 to conductive patch 10. The remainder of the electromagnetic energy passes through a second input/output port 16. As with the embodiment of FIGS. 1 and 2, the amount of transmission line between the apertures, the orientation of the apertures relative to the patch 10, the dimensions of the apertures, and the location at which coplanar transmission line 14 intersects the apertures all work in concert to adapt the antenna for circular polarization. In the case of the circular patch of FIG. 3, the effect is to excite two othogonal $TM_{11}$ modes in equal amplitude phase quadrature.

Figure 5:
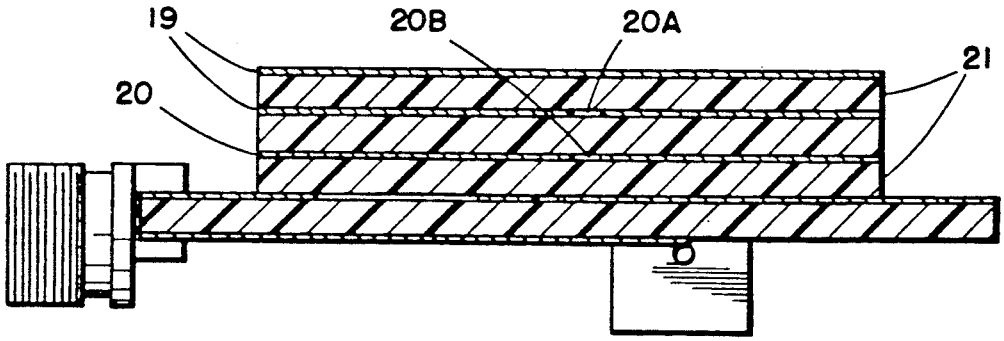
FIG. 5 is a side view of the planar antenna of FIG. 3 with multiple parallel stacked conductive patches.

Referring now to FIG. 5, a modification to the radiating patch structure is shown which is usable with either of the aforementioned antenna structures. The modification is accomplished by stacking a plurality of conductive patches 19 in a parallel fashion above radiating patch 20. Each parallel conductive patch 19 is supported by a dielectric substrate 21 or may be affixed in some manner to reside over, but not in conductive contact with, lower patch 20. Coupling between these patches can be controlled either by their relative sizes or by placing coupling apertures **20*a*, 20*b*** in the lower patches.

Figure 7:
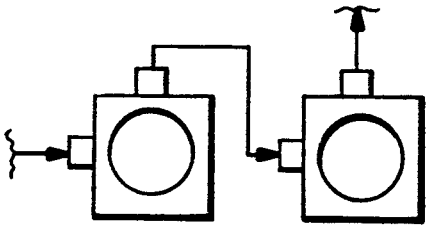
FIG. 7 is a top view of a planar antenna incorporating the invention, with series connected antennas.

While the above antenna structures have been described as unitary antennas, each may be series connected with another by not terminating its non-input port, and connecting it to the input port of the next antenna in line, as shown in FIG. 7. If the described antennas are to be use in a reception mode, one port is terminated and the other is employed as the output. Also, while conductive patch 1 has been described as circular, it may be configured as a square patch. Finally, while two coupling apertures have been shown, additional coupling apertures (e.g., 4 apertures which are orthogonally oriented) may be employed. Similar procedures to those described above are required to be followed to assure that each aperture couples the same amount of energy to the patch, even though different amounts of energy are present at the different apertures. As before, the phasing at each aperture is controlled by the length of the interconnecting transmission line. With 4 apertures, the relative phasing is 0, 90, 180 and 270 degrees.

We claim:

1. A low-profile antenna for sending and/or receiving circularly polarized waves and which employs aperture coupling with a series feed line, the combination comprising:

conductive patch means substantially parallel to and supported above a first surface of a conductive ground plane;

at least first and second orthogonally oriented, coupling apertures formed in the said ground plane, said apertures positioned beneath said conductive patch means;

a pair of coupling means; and a microstrip transmission line series connected between said coupling means and positioned parallel to and supported below a second surface of said ground plane, said transmission line positioned to pass beneath both said apertures, said coupling means positioned at both ends of said microstrip transmission line for connection to external circuitry.

2. The low profile antenna of claim 1, wherein said coupling apertures as elongated and their elongated dimensions are orthogonally oriented.

3. The low profile antenna of claim 2, wherein said microstrip transmission line passes beneath said apertures orthogonally to their elongated dimensions.

4. The low profile antenna of claim 3, wherein said microstrip transmission line is so positioned beneath said apertures as to couple the same amounts of energy through said apertures to said conductive patch.

5. The low profile antenna of claim 4, wherein the length of said microstrip transmission line between said apertures is set to assure that quadrature phase relationships exist at said apertures.

6. The low profile antenna of claim 5, wherein planar dielectric means are positioned between said conductive patch means and said ground plane, and between said ground plane and said microstrip transmission line, said antenna thereby having a unitary sandwich-like structure.

7. The low profile antenna of claim 6, wherein said conductive patch means comprises a plurality of parallel oriented planar conductors separated by planar dielectric means, planar conductors beneath an uppermost one of said planar conductors including coupling apertures.

8. The low profile antenna of claim 7, wherein a plurality of antennas are connected in series by interconnected coupling means.

9. The low profile antenna of claim 6, wherein one of said coupling means has connected thereto a source of microwave energy, and a second said coupling means has connected thereto a terminating impedance.

10. A low-profile antenna for sending and/or receiving circularly polarized waves and which employs aperture coupling with a series feed line, the combination comprising:

conductive patch means substantially parallel to and supported above a first surface of a conductive ground plane;

at least first and second orthogonally oriented, coupling apertures formed in the said ground plane, said apertures positioned beneath said conductive patch means;

a pair of coupling means; and a coplanar waveguide comprising a central strip disposed within a channel in said ground plane, said waveguide positioned to intersect both said apertures,

11. The low profile antenna of claim 10, wherein said coupling apertures are elongated and their elongated dimensions are orthogonally oriented.

12. The low profile antenna of claim 11, wherein said coplanar waveguide intersects said apertures orthogonally to their elongated dimensions.

13. The low profile antenna of claim 12, wherein said coplanar waveguide is positioned to intersect said apertures so as to couple the same amounts of energy into said apertures and to said conductive patch.

14. The low profile antenna of claim 13, wherein the length of said coplanar waveguide between said apertures is set to assure that quadrature phase relationships exist at said apertures.

15. The low profile antenna of claim 14, wherein planar dielectric means is positioned between said conductive patch means and said ground plane, said antenna thereby having a unitary sandwich-like structure.

16. The low profile antenna of claim 15, wherein said conductive patch means comprises a plurality of parallel oriented planar conductors separated by planar dielectric means, planar conductors beneath an uppermost planar conductor including coupling apertures.

17. The low profile antenna of claim 16, wherein a plurality of antennas are connected in series through interconnection of said coupling means.

18. The low profile antenna of claim 15, wherein one said coupling means has connected thereto a source of microwave energy, and a second said coupling means has connected thereto a terminating impedance.

* * * * *